United States Patent [19]

Yamaga et al.

[11] 4,062,263

[45] Dec. 13, 1977

[54] AUTOMATIC RHYTHM PERFORMING APPARATUS

[75] Inventors: Eiichi Yamaga; Eiichiro Aoki, both of Hamamatsu, Japan

[73] Assignee: Nippon Gakki Seizo Kabushiki Kaisha, Shizuoka, Japan

[21] Appl. No.: 725,198

[22] Filed: Sept. 21, 1976

[30] Foreign Application Priority Data

Sept. 25, 1975 Japan ..... 50-114851

[51] Int. Cl.[2] ..... G10F 1/00

[52] U.S. Cl. ..... 84/1.03; 84/DIG. 10; 84/DIG. 12; 84/1.01

[58] Field of Search ..... 84/1.03, 1.17, 1.24, 84/DIG. 12, 1.01, DIG. 10

[56] References Cited

U.S. PATENT DOCUMENTS 3,977,290 8/1976 Sakashita ..... 84/DIG. 10

3,986,424 10/1976 Sakashita ..... 84/1.17

*Primary Examiner*—Robert K. Schaefer

*Assistant Examiner*—Leonard Pojunas

*Attorney, Agent, or Firm*—Flynn & Frishauf

[57] ABSTRACT

A control circuit for controlling an automatic rhythm generating circuit of an automatic rhythm performance apparatus comprises a memory for controlling the rhythm start or stop operation of the automatic rhythm generating circuit by an output state, a rhythm performance control signal supply circuit including a plurality of rhythm performance control switches, and a logic circuit having inputs coupled to the outputs of the rhythm performance control signal supply circuit and to the outputs of the memory and having outputs coupled to the inputs of the memory. The state of signals at the outputs of the rhythm performance control signal supply circuit is variable by the operation of the control switches. The logic circuit causes the memory to be set from one output state to another state in response to a variation in the state of signals at the outputs of the rhythm performance control signal supply circuit.

15 Claims, 4 Drawing Figures

CO : $\overline{SY} \cdot \overline{START}$
C1 : $\overline{SY} \cdot START$
C2 : $SY \cdot \overline{START}$
C3 : $SY \cdot START$

AUTOMATIC RHYTHM PERFORMING APPARATUS

BACKGROUND OF THE INVENTION

This invention relates to an automatic rhythm performing apparatus.

A variety of automatic rhythm performing apparatus for electronically generating rhythm tones are employed with various musical instruments. In such automatic rhythm performing apparatus, a rhythm to be generated can be readily selected before performance of a musical instrument by suitable selection means such as switches etc. It is, however, difficult to effect a start-stop control of a rhythm performance in time with the performance of another musical instrument. A simplest method for a start control, for example, is to start a rhythm performance by closing a start switch. In this case, an unavoidable result is that the performance of the musical instrument is started after a rhythm performance has been started. Therefore, rhythmical tones precedes the performance of the musical instrument.

Some existing automatic rhythm performing apparatus is built in an electronic musical instrument and is provided with a "synchrostart switch" and after the closure of the synchrostart switch a rhythm performance is started in synchronism with the operation of a lower keyboard or a pedal keyboard of the electronic musical instrument. Where an automatic rhythm performing apparatus is used in combination with an electronic musical instrument, it is desired that a rhythm performance can be started by the operation of a start switch, that a rhythm performance can be started, after the operation of a synchrostart switch, in synchronism with the operation of a keyboard, and that a rhythm performance can be started or stopped at player's will during rhythm performance.

SUMMARY OF THE INVENTION

It is accordingly the object of this invention to provide an automatic rhythm performing apparatus capable of easily effecting a start-stop control of a rhythm performance during the performance of an electronic musical instrument.

An automatic rhythm performing apparatus according to this invention is comprised of an automatic rhythm generating circuit means and a control circuit means for forming a plurality of control states to control the automatic rhythm generating circuit means by the operation of a plurality of rhythm performance control switches. The control circuit means includes memory means adapted to form in response to any one of a plurality of input states a corresponding output state and hold the output state until the input state is varied, a rhythm performance control signal providing means having a plurality of rhythm performance control switches and adapted to provide a plurality of rhythm performance control signals, and a logic means having inputs coupled to the outputs of the rhythm performance control signal providing means and to the outputs of the memory means and having outputs coupled to the inputs of the memory means. The state of the rhythm performance control signals is variable by the operation of the rhythm performance control switch. The operation of the rhythm performance control switch causes the memory means to be set to a new output state. The automatic rhythm generating circuit means is coupled to the outputs of the memory means to effect a rhythm start or stop control by a preselected one of a plurality of output states which are assumed by the memory means.

According to one embodiment of this invention the rhythm performance control signal providing means comprises a start switch, synchrostart switch and foot switch and the output of a synchronizing pulse generating means operatively coupled to the keyboard of an electronic musical instrument to generate a synchronizing pulse in response to a key operation is coupled to the logic means. The operation of the start switch sets the memory means to a rhythm start output state which causes the automatic rhythm generating circuit to start a rhythm performance. The operation of the synchrostart switch sets the memory means to a rhythm start synchro state which causes the automatic rhythm generating circuit to start a rhythm performance in synchronism with the operation of the keyboard after the operation of the synchrostart switch. When the memory means is set to a rhythm performing state the memory means is set to rhythm start and stop states alternatively by the repetitive operation of the foot switch.

DETAILED DESCRIPTION OF THE PREFERRED EMBODIMENTS

An automatic rhythm performing apparatus according to the embodiment of this invention has, as rhythm performing control switches, a start tablet switch (START), synchrostart tablet switch (SY) and start-stop foot switch (FS). The control operation of each control switch is as follows. Upon closure of the start tablet switch (START) a preselected rhythm is generated at a preset tempo and upon opening the start tablet switch the rhythm performance is stopped. When after the closure of the synchrostart tablet switch (SY) any key on a keyboard of an electronic musical instrument is depressed, a rhythm performance starts for the first time. The start-stop foot switch (FS) is effective only when a rhythm performance is effected by an operation of the start tablet switch or the synchrostart tablet switch, and the rhythm performance is alternatively started and stopped through the repetitive operation of the foot switch (FS) by the foot of a player. When the start control of the rhythm performance is effected by the foot switch, the rhythm performance starts always from a stressed beat (down beat) or first beat of a measure.

An automatic rhythm performing apparatus may include a tempo lamp so that the tempo of a rhythm to be generated can be visually displayed. The tempo lamp can be controlled as follows:

A. Even when any rhythm is set, if the rhythm performance is stopped, i.e., if the start switch and synchrostart switch are both rendered OFF, the tempo lamp is not lighted.

B. When the start tablet switch is closed, a rhythm performance is started and the lamp is lighted in synchronism with the first beat in each measure of the rhythm being generated.

C. When in the state (A) the synchrostart switch is closed, the lamp is lighted in synchronism with quarter notes of a rhythm.

D. When in the state (C) the start tablet switch is closed or a keyboard is operated a rhythm performance is started, and the lamp is lighted in synchronism with the first beat in each measure of a rhythm.

Figure 1:
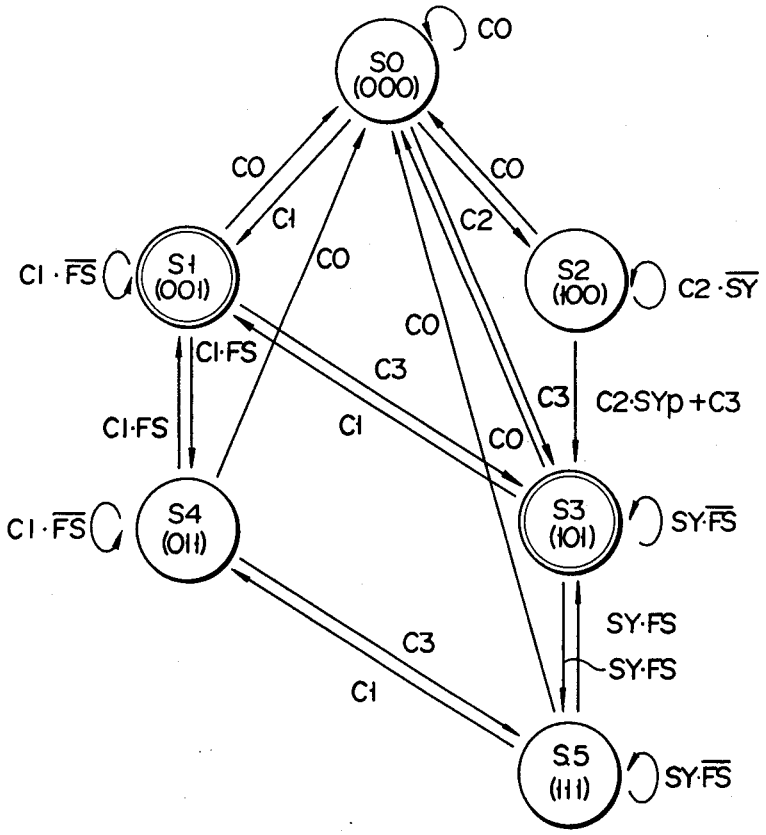
FIG. 1 is a state flow chart showing the rhythm performance control of an automatic rhythm performance apparatus according to an embodiment of this invention.

FIG. 1 is a state flow chart showing a plurality of control states in the automatic rhythm performing apparatus as described above. In this embodiment, there are six states S0 to S5 to be set. The six states S0 to S5 are set as follows:

S0: All the rhythm performing control switches are rendered OFF. In this state no rhythm performance is effected and no tempo lamp is lighted.

S1: This state is set by closing the switch START and a rhythm performance is started from a first beat.

S2: This state is set when in the state S0 the switch SY is closed. In this state S2 no rhythm performance is started, but the tempo lamp is lighted in synchronism with quarter notes.

S3: This state is set by a synchronizing pulse $SY_P$ generated in synchronism with the operation of the lower keyboard or the pedal keyboard in the electronic musical instrument, or by closing the switch START in the state S2. In this state a rhythm performance is started from the first beat and the tempo lamp is lighted in synchronism with the first beat of each measure.

S4: This state is set when in the state S1 the switch FS is operated. No tempo lamp is lighted in this state. The further operation of the switch FS permits this state to be returned to the state S1.

S5: This state is set when in the state S3 the switch FS is operated. In this state no rhythm performance is started, but the tempo lamp is lighted in the same way as in the state S2.

Each of the states S1 to S5 is returned to the state S0 when the switches SY and START are rendered OFF.

In FIG. 1 the states as indicated by double circles show a rhythm performance running state.

The state flow chart in FIG. 1 can be expressed in a state table or a flow table as follows:

Table 1

| | PRESENT STATES F1 | F2 | F3 | INFREQUENT VARIABLES | NEXT STATES F1 | F2 | F3 |
|---|---|---|---|---|---|---|---|
| S0 | 0 | 0 | 0 | $\overline{SY}$ . $\overline{START}$ | 0 | 0 | 0 |
| | 0 | 0 | 0 | SU . START | 0 | 0 | 1 |
| | 0 | 0 | 0 | SY . $\overline{START}$ | 1 | 0 | 0 |
| | 0 | 0 | 0 | $\overline{SY}$ . $\overline{START}$ | 1 | 0 | 1 |
| | 0 | 0 | 1 | $\overline{SY}$ . $\overline{START}$ | 0 | 0 | 0 |
| | 0 | 0 | 1 | SY . START | 1 | 0 | 1 |
| S1 | 0 | 0 | 1 | $\overline{FS}$ . $\overline{SY}$ . START | 0 | 1 | 1 |
| | 0 | 0 | 1 | FS . START | 0 | 0 | 1 |
| | 0 | 1 | 1 | SY . $\overline{START}$ | 1 | 1 | 1 |
| | 0 | 1 | 1 | FS . SY . START | 0 | 0 | 1 |
| S4 | 0 | 1 | 1 | $\overline{SY}$ . $\overline{START}$ | 0 | 0 | 0 |
| | 0 | 1 | 1 | $\overline{FS}$ . $\overline{SU}$ START | 0 | 1 | 1 |
| | 1 | 0 | 0 | $\overline{SY}$ . $\overline{START}$ | 0 | 0 | 0 |
| S2 | 1 | 0 | 0 | $\overline{SYp}$ . SY . $\overline{START}$ | 1 | 0 | 0 |
| | 1 | 0 | 0 | SYp . SY . START ±$\overline{SY}$ . $\overline{START}$ | 1 | 0 | 1 |
| | 1 | 0 | 1 | $\overline{SY}$ . $\overline{START}$ | 0 | 0 | 0 |
| | 1 | 0 | 1 | SY . START | 0 | 0 | 1 |

Table 1-continued

| | PRESENT STATES F1 | F2 | F3 | INFREQUENT VARIABLES | NEXT STATES F1 | F2 | F3 |
|---|---|---|---|---|---|---|---|
| S3 | 1 | 0 | 1 | $\overline{FS}$ . SY | 1 | 1 | 1 |
| | 1 | 1 | 1 | $\overline{FS}$ . SY | 1 | 0 | 1 |
| | 1 | 1 | 1 | FS SY | 1 | 1 | 1 |
| | 1 | 1 | 1 | SY . START | 0 | 1 | 1 |
| S5 | 1 | 1 | 1 | $\overline{FS}$ . SY | 1 | 0 | 1 |
| | 1 | 1 | 1 | SY . START | 0 | 0 | 0 |

Figure 2:
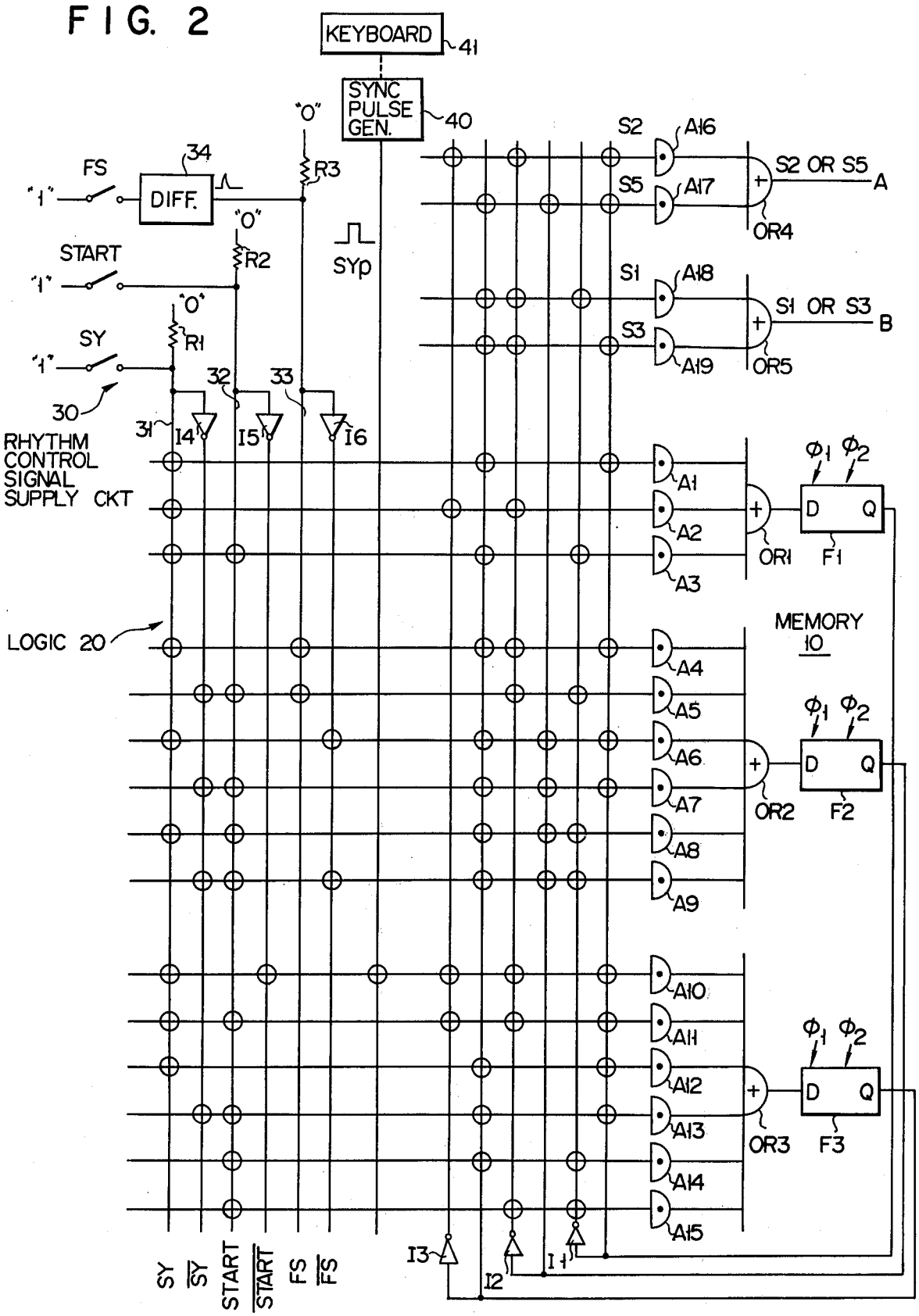
FIG. 2 is a circuit diagram of a control circuit of an automatic rhythm performing apparatus as constructed based on the state flow chart in FIG. 1.

FIG. 2 shows a state control circuit which is arranged based on the states in Table 1. The control circuit includes a memory 10 comprised of D-type (delay) flip-flop circuit F1, F2 and F3 which are driven by, for example, 250 kHz two-phase clock signals $\phi 1$ and $\phi 2$. The memory 10 has outputs set to a state by which an automatic rhythm generating circuit and tempo display circuit as will be later described are controlled. Each output state is determined by a logical level "1" or "0" of each output of the flip-flop circuits F1, F2 and F3. A logic circuit 20 for controlling the output state of the memory 10 is connected to the inputs of the flip-flop circuits F1, F2 and F3. The logic circuit 20 includes AND circuits A1 to A15. The outputs of the AND CIRCUITS A1 to A3 are connected through an OR circuit OR1 to the input of the flip-flop circuit F1; the outputs of the AND circuits A4 to A9 are connected through an OR circuit OR2 to the input of the flip-flop circuit F2; and the outputs of the AND circuits A10 to A15 are connected through an OR circuit OR3 to the input of the flip-flop circuit F3. The outputs of the memory 10 are connected directly and through inverters I1 and I2 and I3 to the inputs of the logic circuit 20 and the outputs 31, 32 and 33 of the control signal supplying circuit 30 are connected directly and through inverters I4, I5 and I6 to the inputs of the logic circuit 20. The outputs 31, 32 and 33 are connected respectively through R1, R2 and R3 to a logical "0" level voltage source and respectively through the synchrostart tablet switch SY, start tablet switch START and start-stop foot switch FS to a logical "1" level voltage source. The foot switch FS is connected through a differentiator 34 to the output 33 of the control signal supplying circuit 30.

By the operation of each switch the signal levels of the outputs of the control signal supplying circuit 30 are varied to cause the memory 10 to be set to a new state. In this case, the variation of the output state of the control signal supplying circuit by the operation of the start switch START and synchrostart switch SY is continued until the subsequent switch operation, but the variation of the output state of the control signal supplying circuit by the operation of the foot state FS is instantaneous due to the presence of the differentiating circuit 34.

The output of a synchronizing pulse generator 40 operatively coupled to a keyboard 41 to generate a synchronizing pulse $SY_P$ in response to key operation on the keyboard 41 is coupled to the logic circuit 20.

The relation of the state S0 to S5 to the output voltage levels of the flip-flop circuits F1, F2 and F3 of the memory 10 is selected as shown in Table 2.

Table 2

| | F1 | F2 | F3 |
|---|---|---|---|
| S0 | 0 | 0 | 0 |
| S1 | 0 | 0 | 1 |

Table 2-continued

| | F1 | F2 | F3 |
|---|---|---|---|
| S2 | 1 | 0 | 0 |
| S3 | 1 | 0 | 1 |
| S4 | 0 | 1 | 1 |
| S5 | 1 | 1 | 1 |

The output state of the memory 10 is controlled by the output state of the control signal supply circuit 30. When the start switch START and synchrostart switch SY is both in the OFF state, a logical "0" level signal is coupled to the And circuits A1 to A15 and thus the output voltages of the OR circuits OR1, OR2 and OR3 are at the "0" level. Accordingly, since the outputs of the flip-flop circuits F1, F2 and F3 are at the "0" level the memory 10 is set to the state S0. When in the state S0 only the start switch START is closed, only the AND circuit A15 generates an output of logical "1" level and in consequence the output of the flip-flop circuit F3 becomes "1" level. That is, the memory 10 is switched from the state S0 to the state S1 by the operation of the start switch START. When in the state S0 the synchroswitch SY is closed, only the AND circuit A2 generates an output having a "1" level and in consequence the output of the flip-flop circuit F1 becomes a "1" level. That is, the memory 10 is switched from the state S0 to the state S2 by the operation of the synchrostart switch. When in the state S1 (001) the foot switch FS is closed, the AND gate A5 produces a logical "1" level output and in consequence the output of the flip-flop circuit F2 becomes a logical "1" level. That is, when in the state S1 the foot switch FS is closed, the memory 10 is switched from the state S1 to the state S4 (011). The state S4 is maintained since the output of the AND circuit A9 becomes a "1" level. That is, the state S4 is maintained even when the foot switch is opened. By the next operation of the foot switch FS the output of the AND gate becomes a "0" level and in consequence the memory 10 is switched from the state S4 to the state S1. When in the state S2 (100) the keyboard 41 is operated, the synchronizing pulse $SY_P$ is coupled to the AND circuit A10 and the output of the AND circuit A10 becomes a "1" level the instant the keyboard is operated. As a result, the output of the flip-flop F3 becomes a "1" level. That is, when in the state S2 the keyboard is operated, the memory 10 is switched from the state S2 (100) to the state S3 (101). As a result, the output of the AND circuit A12 is maintained at the "1" level and the memory 10 holds the state S3.

As mentioned above, the memory 10 can be set to any one of the states S0 to S5 by operating each switch and keyboard 41 and the switching of the memory 10 from one state to another is effected by the functions of switch operation indicated by C0 to C3.

As shown in FIG. 2 the outputs of the memory 10 are coupled to the inputs of the AND circuits A16 to A19. The outputs of the AND circuits A16 and A17 are coupled to the inputs of the OR circuit OR4 and the outputs of the AND circuits A18 and A19 are coupled to the inputs of the OR circuit OR5. The AND circuits A16 and A19 are provided to decode the ouptut state of the memory 10. That is, the AND circuit A16 decodes the state S2, the AND circuit A17 decodes the state S5, and AND circuit A18 decodes the state S1 and the AND circuit A19 decodes the state S3. When the memory 10 is set to the state S2 or S5, a logical "1" level signal A for controlling the tempo indication circuit appears at the output of the OR circuit OR4. When the memory 10 is set to the state S1 or S3, a logical "1" level signal B for controlling the automatic rhythm generating circuit and tempo indication circuit appears at the output of the OR circuit OR5.

Figure 3:
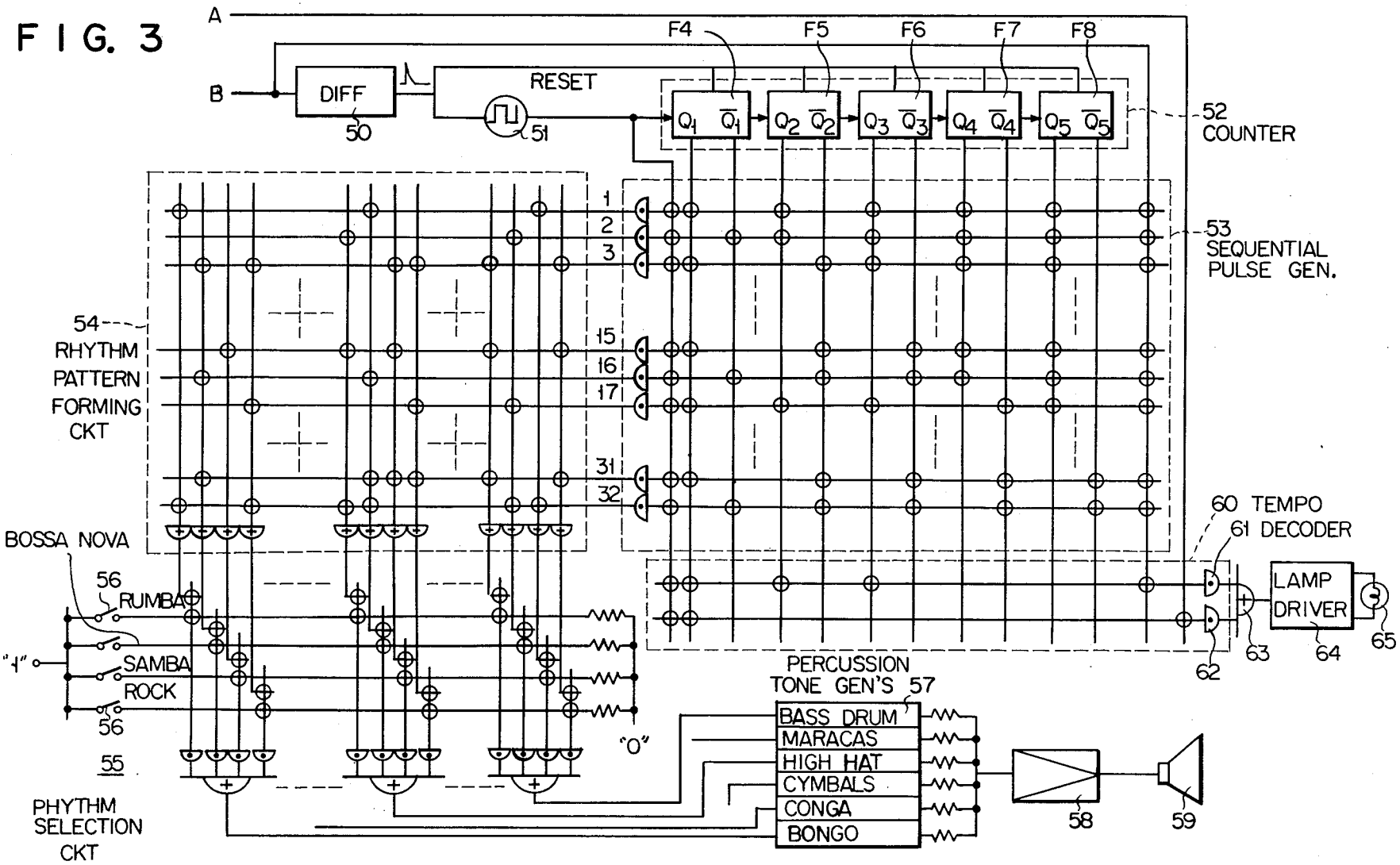
FIG. 3 shows by way of example a circuit diagram of an automatic rhythm generating circuit and tempo indication circuit as controlled by the control circuit in FIG. 2.

FIG. 3 shows the automatic rhythm generating circuit and tempo indication circuit as controlled by the control circuit in FIG. 2. The output of a differentiator 50, to which the control signal B from the control circuit is coupled, controls the clock generator 51 to start synchronized oscillation. The clock signal of the clock generator 51 is supplied to a counter circuit 52 comprised of cascadeconnected flip-flop circuits F4 to F8. Each flip-flop circuit in the counter circuit 52 is reset by the output of the differentiator 50 to count clock signals from an initial value. It is desirable that the clock generator 51 be designed to have an oscillation frequency varied from several Hz to several tens of Hz. Where the period of time of the clock signals of the clock generator 51 corresponds to the duration of an eighth note tone, the period of time of the outputs Q1, $\bar{Q}$1 of the flip-flop circuit F4 corresponds to the duration of a quarter note tone, the period of time of the outputs Q2, $\bar{Q}$2 of the flip-flop circuit F5 corresponds to the duration of a half note tone, and the period of time of the outputs Q3 and $\bar{Q}$3 of the flip-flop circuit F6 corresponds to one measure.

The outputs of the clock generator 51 and outputs of the respective flip-flop circuits in the counter 52 are coupled to a sequential pulse generating circuit 53 to generate 32 sequential pulses. The signal B of the control circuit is coupled to the sequential pulse generating circuit 53 so that only when the above-mentioned memory 10 is set to the state S1 or S3 the sequential pulse generator 53 is enabled to generate the sequential pulses.

The 32 sequential pulses of the sequential pulse generating circuit 53 are supplied to a rhythm pattern forming circuit 54 to generate various kinds of rhythm pattern signals. Desired rhythm pattern signals are selected by a rhythm selection circuit 55 having rhythm selection switches 56 to drive percussion tone generators 57. Selected tone signals from the percussion tone generators 57 are delivered to an amplifier 58 and then to a loudspeaker 59 to sound desired rhythm tones.

Reference numeral 60 is a tempo decoder 60 which includes AND circuits 61 and 62. To the AND circuit 61 are coupled clock signals, output Q1 of the flip-flop circuit F4, output Q2 of the flip-flop circuit F5, output Q3 of the flip-flop circuit F6 respectively shown in FIGS. 4A, 4B, 4C and 4D and signal B. To the AND circuit 62 are coupled the clock signals, the output Q1 of the flip-flop circuit F4 and the control signal A. The outputs of the AND circuits 61 and 62 in the tempo decoder 60 are connected through an OR circuit 63 to a lamp driver 64 for lighting a tempo indication lamp 65.

Figure 4:
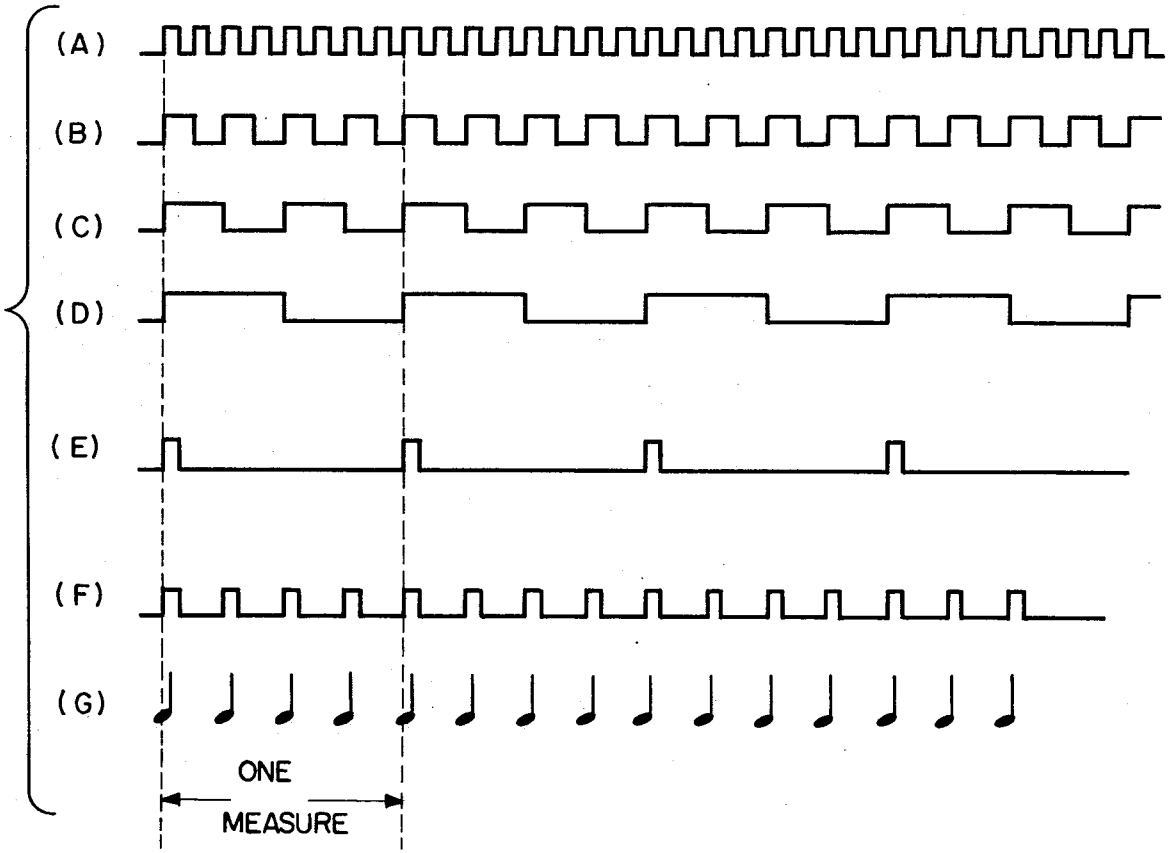
FIG. 4 is a timing chart useful in explaining a tempo indication.

When the signal B is present, i.e., the memory 10 holds the state S1 or S3, the AND circuit 61 in the decoder 60 is enabled to generate pulse outputs in synchronism with the first beat of each measure as shown in FIG. 4E. That is, during the rhythm performance the tempo display lamp 65 is lighted in response to a pulse signal as shown in FIG. 4E and in synchronism with the first beat of each measure.

When the signal A is present, i.e., when the memory 10 holds the synchrostate S2 or S5, the AND circuit 62 in the decoder 60 is enabled to generate pulses corresponding to four quarter notes of each measure as shown in FIG. 4G. That is, in the rhythm synchrostate, the tempo display lamp 65 is lighted in response to a pulse signal as shown in FIG. 4F and in synchronism with the quarter notes of each measure.

In the rhythm synchrostate the tempo display lamp 65 is lighted in synchronism with the quarter note and in the rhythm performance state the tempo display lamp 65 is lighted in synchronism with the first beat of each measure. However, the decoder 60 may be suitably designed so that the lamp can be lighted at a suitable timing. It will be evident that the counter circuit 52 and decoder 60 may be controlled by rhythm selection switches 56 so that output pulses of different rhythms, for example, $\frac{3}{4}$ time and 4/4 time can be selectively derived, and tempo indication corresponding to such rhythms can be effected.

What we claim is:

1. An automatic rhythm performing apparatus comprising:

memory means having inputs and outputs and holding at the outputs thereof a state of output signals which corresponds to a state of input signals at the inputs thereof, said memory assuming a plurality of output states according to a plurality of input states;

automatic rhythm generating circuit means coupled to the outputs of said memory means for starting or stopping a rhythm performance in response to preselected output state of said memory means;

rhythm performance control signal providing means having a plurality of rhythm performance control switches and outputs, and providing a plurality of rhythm performance control signals to the outputs thereof, a state of rhythm performance control signals at the outputs of said rhythm performance control signal providing means being variable by operation of said rhythm performance control switches; and logic means having inputs coupled to the outputs of said rhythm performance control signal providing means and to the outputs of said memory means, and having outputs coupled to the inputs of said memory means for setting said memory means from an output state to another output state in response to a variation in a state of control signals at the outputs of said rhythm performance control signal providing means.

2. An automatic rhythm performing apparatus according to claim 1 further comprising tempo indicator means coupled to the outputs of said memory means and said automatic rhythm generating circuit means.

3. An automatic rhythm performing apparatus according to claim 1 in which said memory means has a plurality of flip-flop circuits.

4. An automatic rhythm performing apparatus according to claim 3 in which said flip-flop circuits are D-type flip-flop circuits.

5. An automatic rhythm performing apparatus comprising:

memory means having inputs and outputs and holding at the outputs thereof a state of output signals which corresponds to a state of input signals at the inputs thereof, said memory means assuming a plurality of output states according to a corresponding number of input states;

automatic rhythm generating circuit means coupled to the outputs of said memory means to start or stop a rhythm performance in response to preselected output states of said memory means;

keyboard means having keys;

synchronizing pulse generating means operatively coupled to said keyboard means to generate a synchronizing pulse in response to a key operation on said keyboard;

rhythm performance control signal providing means having rhythm performance control switches and outputs and providing a plurality of rhythm performance control signals to the outputs thereof, a state of the rhythm control signals at the outputs of said rhythm performance control signal providing means being variable by operation of said rhythm performance control switches; and logic means having inputs coupled to the outputs of said rhythm performance control signal providing means, the outputs of said memory means and the output of said synchronizing pulse generating means, and outputs coupled to the inputs of said memory means to set said memory means from an output state to another output state in response to a variation in a state of control signals at the output of said rhythm performance control signal providing means.

6. An automatic rhythm performing apparatus according to claim 5 further comprising tempo indication means coupled to the outputs of said memory means and said automatic rhythm generating means.

7. An automatic rhythm performing apparatus according to claim 5 in which said memory means has a plurality of flip-flop circuits.

8. An automatic rhythm performing apparatus according to claim 7 in which said flip-flop circuits are D-type flip-flop circuits.

9. An automatic rhythm performing apparatus comprising:

memory means having inputs and outputs and holding at the outputs thereof a state of output signals which corresponds to a state of input signals at the inputs thereof, said memory means assuming a plurality of output states according to a plurality of input states;

automatic rhythm generating means coupled to the outputs of said memory means to start or stop a rhythm performance in response to preselected output states of said memory means;

keyborad means having keys;

a synchronizing pulse generating means operatively coupled to said keyboard means to generate a synchronizing pulse in response to a key operation on said keyboard;

a rhythm performance signal providing means having a plurality of rhythm performance control switches and outputs coupled to said switches and providing a plurality of rhythm performance control signals to the outputs thereof, the state of rhythm performance control signals at said outputs being variable by the operation of said switches, said rhythm performance control switches including a start switch, synchrostart switch and foot switch, a variation in the state of rhythm performance control signals at the outputs resulting from the operation of said start switch and synchrostart switch being continuous and a variation in the state of said rhythm performance control signals resulting from the operation of said foot switch being temporary;

logic means having inputs coupled to the outputs of said rhythm performance control signal providing means, the outputs of said memory means and the output of said synchronizing pulse generating means, and outputs coupled to the inputs of said memory means for setting said memory means from an output state to another output state in response to a variation in a state of control signals at the outputs of said rhythm performance control signal providing means, said logic means being operative to set said memory means to a rhythm performance start state in response to the operation of the start switch of said rhythm performance control signal providing means, set said memory means to a state for starting a rhythm performance in response to the synchronizing pulse from said synchronizing pulse generating means after said synchrostart switch is operated, and set said memory means to a temporary rhythm performance stop state during a rhythm performance by the operation of said start switch or said synchrostart switch in response to said foot switch, and to the rhythm performance start state in response to the next subsequent operation of said foot switch.

10. An automatic rhythm performing apparatus according to claim 9 further including tempo indicator means coupled to the outputs of said memory means and said automatic rhythm generating circuit.

11. An automatic rhythm performing apparatus according to claim 9 further including tempo indicator means coupled to the outputs of said memory means and said automatic rhythm generating means and adapted to be enabled in response to the rhythm performance start state of said memory means to light in synchronism with rhythms to be generated.

12. An automatic rhythm performing apparatus according to claim 11 in which said tempo indicator means is operative to light in synchronism with a first beat of a measure.

13. An automatic rhythm performing apparatus according to claim 9 further including tempo indicator means coupled to the outputs of said memory means and said automatic rhythm generating means and adapted to be lighted in response to the rhythm performance stop state of said memory means after said synchrostart switch is operated.

14. An automatic rhythm performing apparatus according to claim 9 in which said memory means includes a plurality of flip-flop circuits.

15. An automatic rhythm performing apparatus according to claim 14 in which said flip-flop circuits are D-type flip-flop circuits.

* * * * *

UNITED STATES PATENT AND TRADEMARK OFFICE

CERTIFICATE OF CORRECTION

PATENT NO. : 4,062,263

DATED : December 13, 1977

INVENTOR(S) : Eiichi YAMAGA, et al

It is certified that error appears in the above-identified patent and that said Letters Patent are hereby corrected as shown below:

Column 3 (Table 1), line 54, change "SU·START" to --SY·START--;
line 60, change "FS·START" to --FS·SY·START--;
line 63, change "FS·SU·START" to --FS·SY·START--.

Signed and Sealed this

*Eighteenth* Day of *April 1978*

[SEAL]

*Attest:*

RUTH C. MASON
*Attesting Officer*

LUTRELLE F. PARKER
*Acting Commissioner of Patents and Trademarks*